US009271628B2

(12) United States Patent
Gunnerson et al.

(10) Patent No.: US 9,271,628 B2
(45) Date of Patent: Mar. 1, 2016

(54) LID OPERATING MECHANISM FOR A DRAWER-TYPE DISHWASHER

(75) Inventors: Kory A. Gunnerson, West Layfayette, IN (US); Kristen K. Hedstrom, Orlando, FL (US); Mark E. Palm, Davie, FL (US); Rodney M. Welch, Beech Bluff, TN (US); Jeffrey N. Williams, Jackson, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 1030 days.

(21) Appl. No.: 12/775,052

(22) Filed: May 6, 2010

(65) Prior Publication Data

US 2010/0212698 A1 Aug. 26, 2010

Related U.S. Application Data

(62) Division of application No. 11/500,986, filed on Aug. 9, 2006, now Pat. No. 7,731,804.

(51) Int. Cl.
*B08B 7/04* (2006.01)
*A47L 15/00* (2006.01)

(52) U.S. Cl.
CPC ..... *A47L 15/0084* (2013.01)

(58) Field of Classification Search
None
See application file for complete search history.

(56) References Cited

U.S. PATENT DOCUMENTS 4,974,750 A * 12/1990 Welch ..... 222/129
5,595,200 A * 1/1997 Favaro ..... 134/201
6,460,555 B1 * 10/2002 Tuller et al. ..... 134/200

* cited by examiner

*Primary Examiner* — Eric Golightly

(57) ABSTRACT

A dishwasher includes an outer housing, a drawer having front, rear, bottom and opposing side walls that collectively define a washing tub, a lid for selectively closing the washing tub and an operating mechanism that raises and lowers the lid as the drawer is shifted into and out of the outer housing. The operating mechanism includes a lifting slider slidably mounted in the outer housing operatively coupled to a lifting spring and a compression slider, also slidably mounted in the outer housing coupled to a compression spring. The lifting slider and compression slider are provided with corresponding lifting rollers and compression rollers that engage the lid. As the drawer is withdrawn from the outer housing, the lifting spring urges the lifting slider upward raising the lid and, as the drawer is inserted into the outer housing, the compression slider forces the lid downward onto the washing tub.

14 Claims, 7 Drawing Sheets

LID OPERATING MECHANISM FOR A DRAWER-TYPE DISHWASHER

The present application is a divisional of U.S. patent application Ser. No. 11/500,986, filed Aug. 9, 2006 entitled "Lid Operating Mechanism for a Drawer-Type Dishwasher", now U.S. Pat. No. 7,731,804 which issued on Jun. 8, 2010.

BACKGROUND OF THE INVENTION

1. Field of the Invention

The present invention pertains to the art of dishwashers and, more particularly, to a mechanism for shifting a lid of a drawer-type dishwasher between open and closed positions.

2. Description of the Related Art

In general, dishwashers having pull-out drawers are known in the art. In some cases, the dishwasher will include an upper, pull-out drawer forming an upper washing chamber for washing smaller objects such as glassware, utensils, small plates and the like, and a lower conventional-type dishwasher. In other cases, the dishwasher will include upper and lower pull-out drawers, or just simply include a single, pull-out drawer. In any event, the washing chamber of the pull-out drawer must be provided with a lid having a water-tight seal that prevents washing fluid from leaking out or otherwise escaping from the dishwasher during a washing operation.

Typically, the lid is pivotally mounted to a frame or housing of the dishwasher above the washing chamber. With this arrangement, when the drawer is withdrawn from the dishwasher, a mechanism elevates the lid relative to the washing chamber and, when the drawer is inserted back into the dishwasher, the mechanism lowers the lid onto the washing chamber. The mechanisms employed in the prior art take on many forms. For example, many mechanisms utilize a system of springs and linkages, while other systems employ motors, solenoids or linear actuators to raise and lower a lid. Still other mechanisms employ a system of cams and springs to operate the lid.

Despite the existence of lid operating mechanisms in the prior art, there still exists a need for a lid operating mechanism that effectively and efficiently shifts a lid of a drawer-type dishwasher between open and closed positions. More specifically, there exists a need for a simple, cost-effective lid operating mechanism that is easy to install and provides a consumer with reliable operation.

SUMMARY OF THE INVENTION

The present invention is directed to a drawer-type dishwasher including an outer housing, a washing tub shiftably mounted in the outer housing, a lid for selectively closing the washing tub and an operating mechanism that raises and lowers the lid as the washing tub is shifted into and out of the outer housing. In accordance with the invention, the operating mechanism includes a lifting slider slidably mounted in the outer housing and operatively coupled to a lifting spring, and a compression slider which is also slidably mounted in the outer housing and operatively coupled to a compression spring.

The lifting slider and compression slider are provided with corresponding lifting rollers and compression rollers that engage the lid. More specifically, the lid includes a top section, a rear section and opposing side sections, with each of the opposing side sections having a lower edge portion and an arcuate opening. The lower edge portion includes at least one recessed portion and at least one raised portion. The lower edge portion of the lid rides upon the lifting rollers while the compression rollers are arranged to travel in the arcuate slot. With this arrangement, as the washing tub is withdrawn from the outer housing, the lifting spring urges the lifting slider upward, thereby automatically raising the lid.

Conversely, as the drawer is inserted or shifted into the outer housing, a rear portion of the washing tub abuts the rear section of the lid, thereby causing the lid to shift horizontally. As the lid shifts horizontally, the compression rollers traverse the arcuate opening and urge the compression sliders downward. The compression sliders then force the lid into sealing relationship with the washing tub. The compression spring supplies sufficient force to overcome the lifting spring and provides a suitable seal about the washing chamber. The operating mechanism is also provided with an alignment aide to ensure a proper alignment between the lid and the washing tub. The alignment aide includes an alignment element arranged on the rear wall of the washing tub and an aligning member arranged on the rear section of the lid. As the washing tub abuts the lid, the aligning member nests into the alignment element to properly position the lid relative to the drawer.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF PREFERRED EMBODIMENTS

Figure 1:
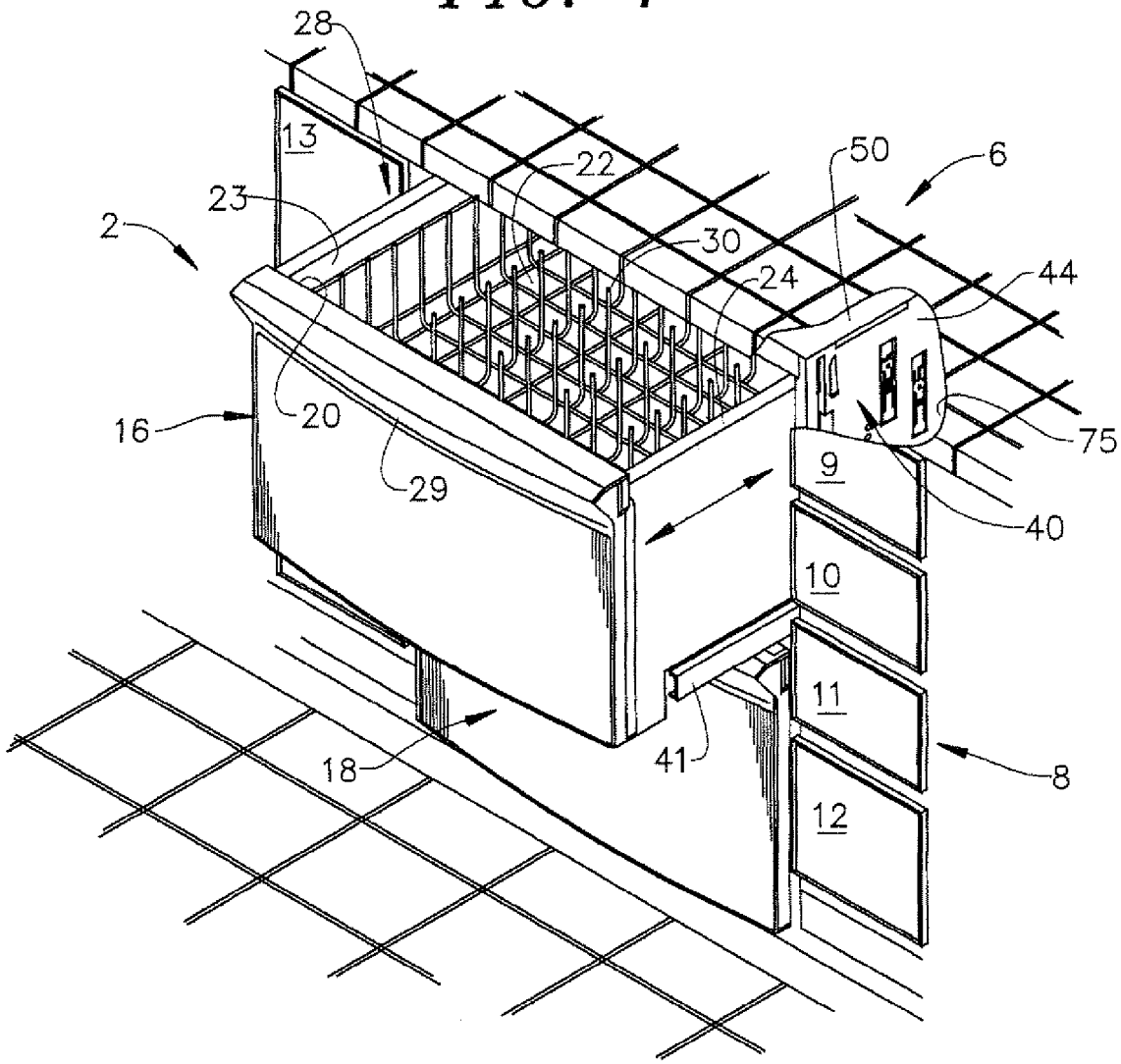
FIG. 1 is an upper right perspective view of a drawer-type dishwasher including a lid operating mechanism constructed in accordance with the present invention installed beneath a kitchen countertop.
Figure 2:
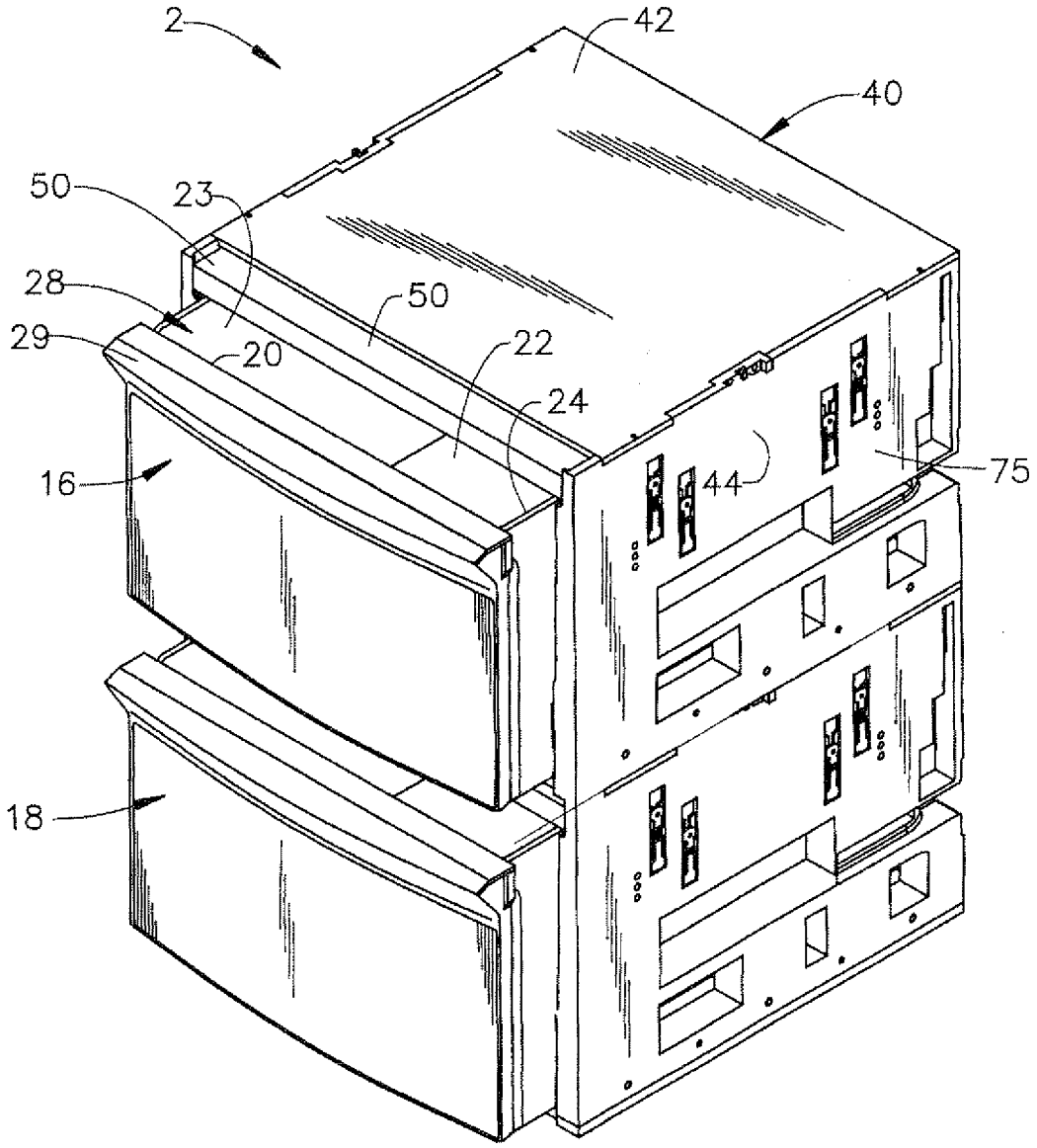
FIG. 2 is an upper right perspective view of the dishwasher of FIG. 1 shown prior to installation.

With initial reference to FIGS. 1 and 2, a dishwasher constructed in accordance with the present invention is generally indicated at 2. As shown, dishwasher 2 is arranged below a kitchen countertop 6. Also shown below kitchen countertop 6 is cabinetry 8 including a plurality of drawers 9-12, as well as a cabinet door 13. Although the actual dishwasher into which the present invention may be incorporated can vary, the invention is shown in connection with dishwasher 2 depicted as a dual cavity dishwasher having an upper drawer 16 and a lower drawer 18.

In accordance with the embodiment shown, upper drawer 16 includes a front wall 20, a rear wall 21 (see FIG. 6), a bottom wall 22 and opposing side walls 23 and 24 that collectively define an upper washing chamber or tub 28. In a manner known in the art, upper drawer 16 is provided with a handle 29 for accessing washing tub 28. In a manner also known in the art, washing tub 28 includes a dish rack 31 for supporting various objects, such as glassware, utensils and the like, to be exposed to a washing operation. Upper drawer 16 is slidably mounted within an outer housing 40 through a pair of extendible drawer support glides or rails, one of which is indicated at 41. As shown, outer housing 40 includes a top wall 42 and opposing side walls 43 and 44 that collectively define an interior cavity 45 (see FIG. 5A). In addition, upper drawer 16 is provided with a vertically shiftable lid member 50 that is adapted to selectively seal against an upper portion (not separately labeled) of washing tub 28. As will be detailed more fully below, an operating mechanism 75 is employed to raise lid 50 when drawer 16 is withdrawn from interior cavity 45 and lower lid 50 onto washing tub 28 when drawer 16 is shifted into interior cavity 45.

Figure 3:
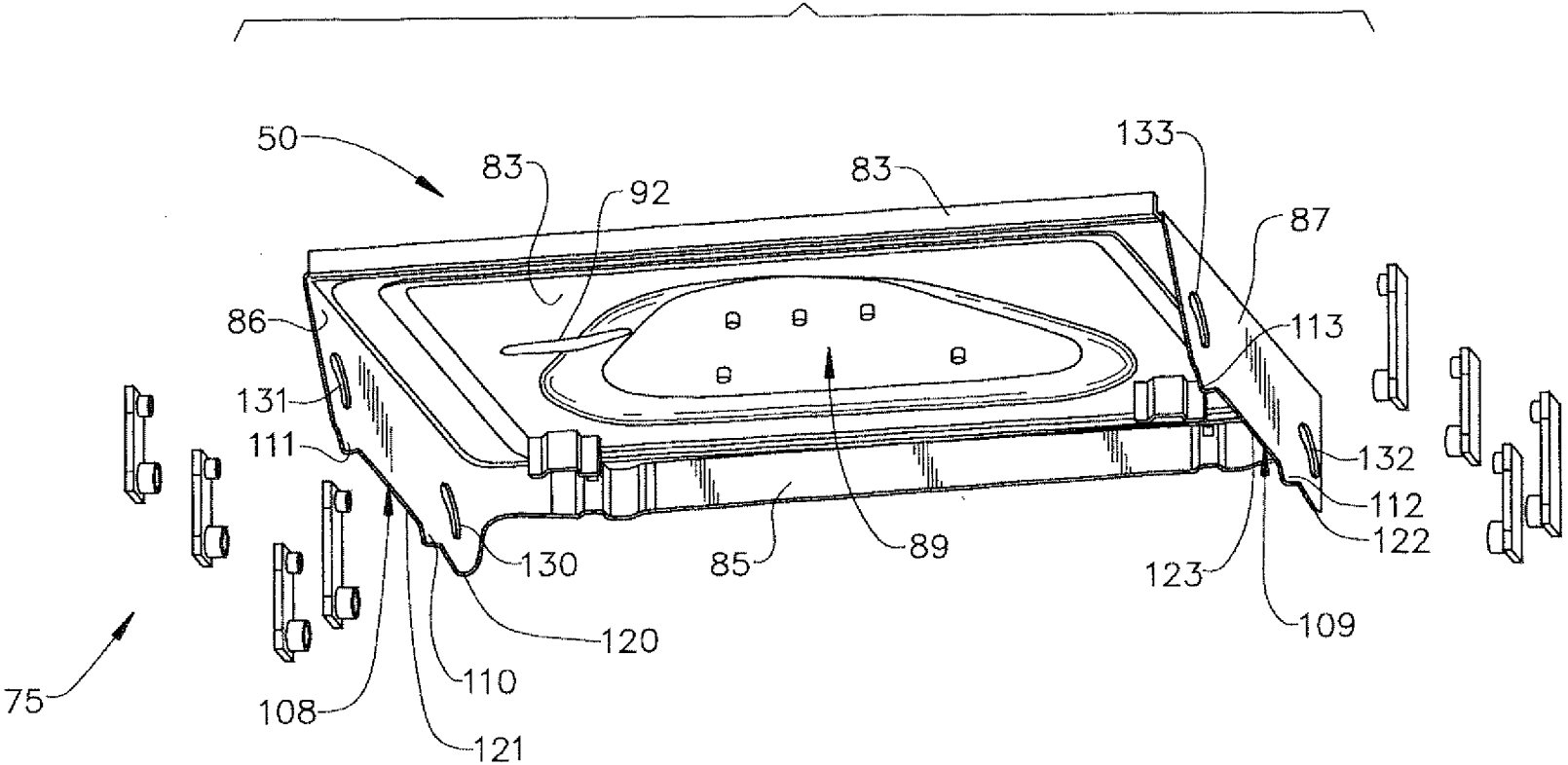
FIG. 3 is a lower right exploded view of a dishwasher lid and lid operating mechanism constructed in accordance with the present invention.
Figure 4:
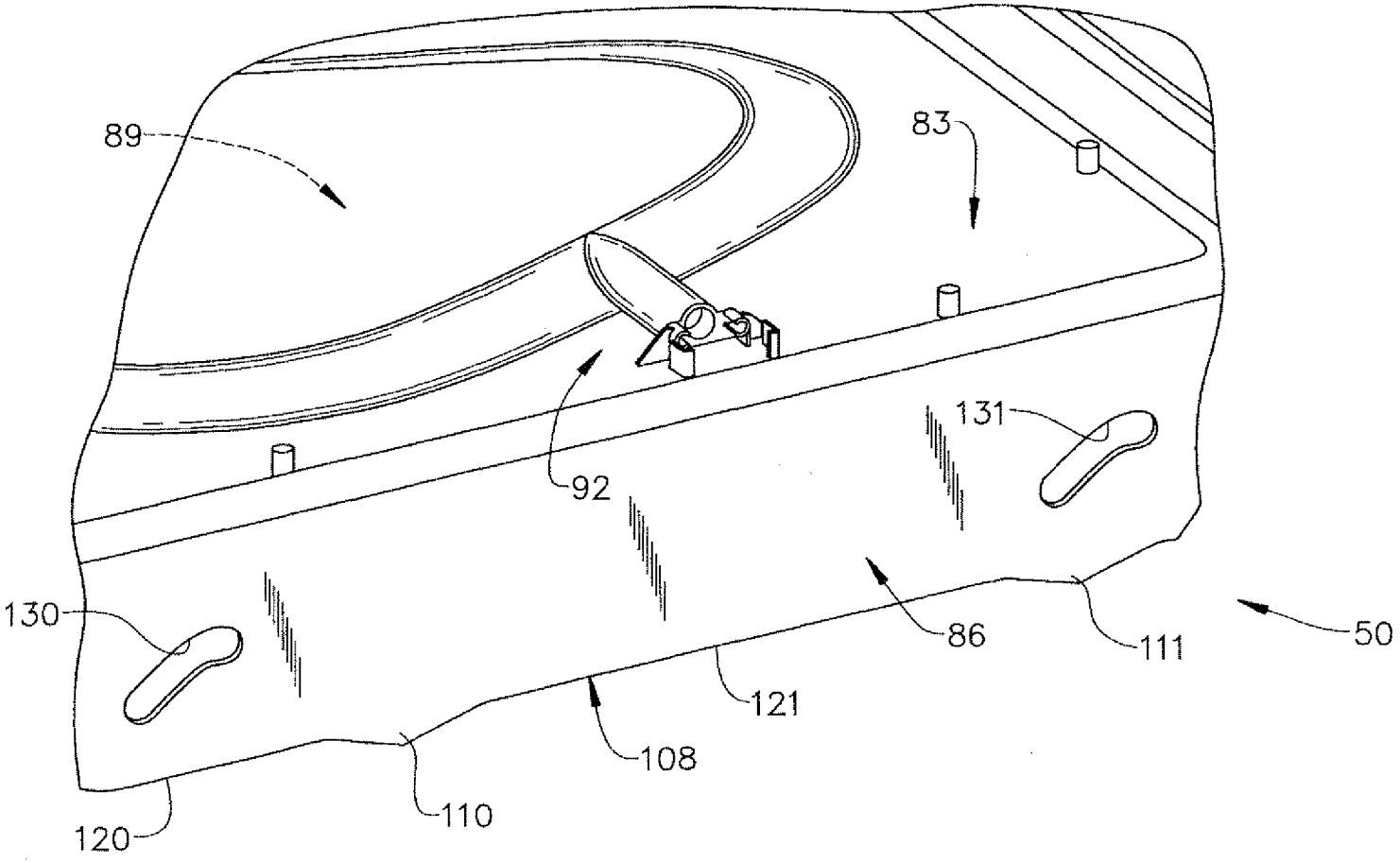
FIG. 4 is a partial, detailed view of a side section of the dishwasher lid of FIG. 3.

Referring to FIGS. 3 and 4, lid 50 includes a top section 83, a front lip 84, a rear section 85 and opposing side sections 86 and 87. Top section 83 includes a central recess 89 within which is mounted a wash arm (not shown). Towards that end, central recess 89 includes a water inlet section 92 to which is mounted plumbing for delivering washing fluid to the wash arm. In any case, each opposing side section 86, 87 includes a corresponding lower edge 108 and 109. Formed on each lower edge 108, 109 are a plurality of raised sections or camming surfaces. More specifically, lower edge 108 includes first and second camming surfaces 110 and 111, while opposing lower edge 109 includes third and fourth camming surfaces 112 and 113. In addition to camming surfaces 110-113, lower edges 108 and 109 include pairs of recessed sections 120, 121 and 122, 123 respectively. Also shown in these figures, opposing side sections 86 and 87 are provided with arcuate openings 130, 131 and 132, 133 respectively.

Figure 5A:
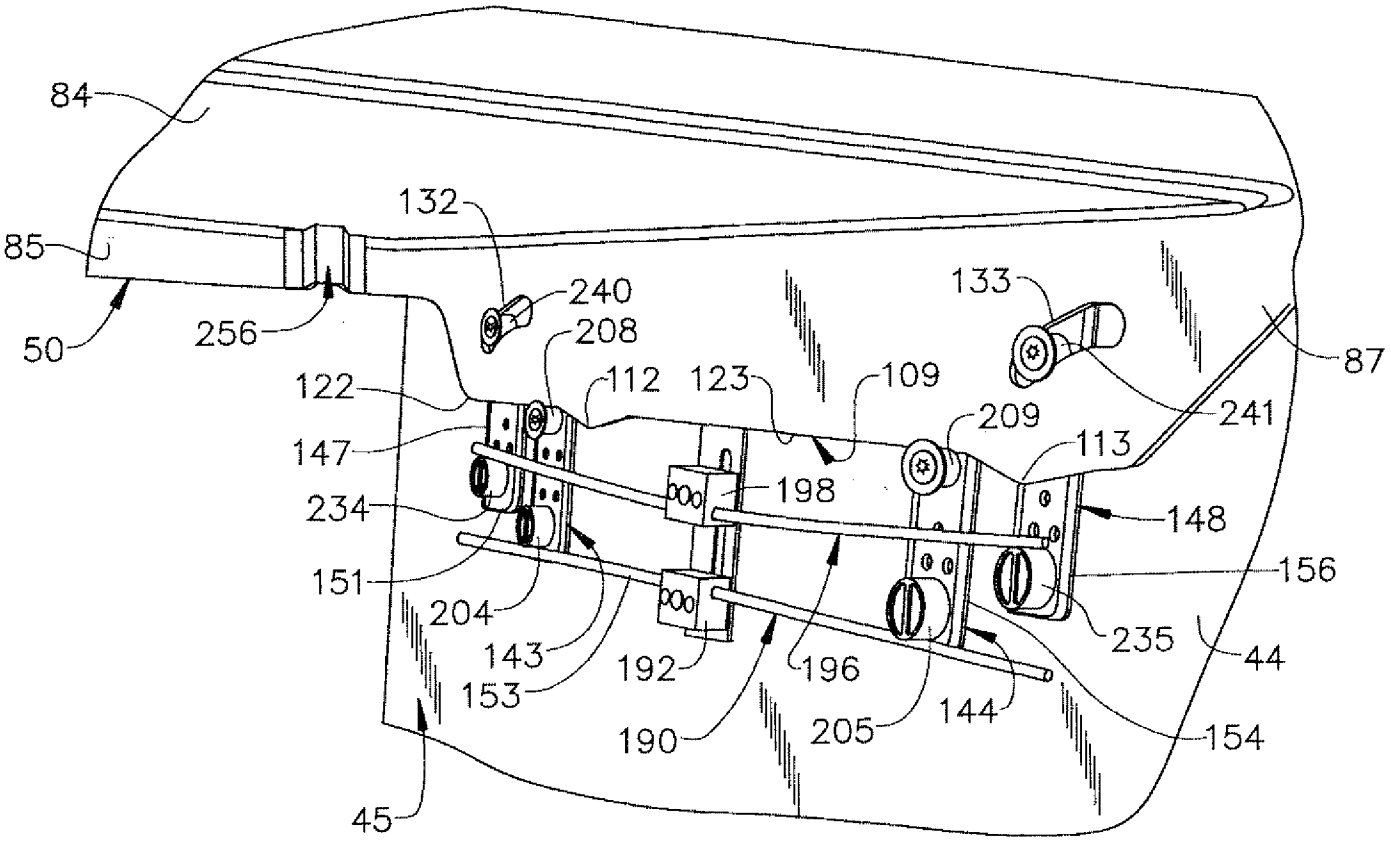
FIG. 5A is a detailed view of the lid operating mechanism of the present invention shown with the dishwasher lid in a raised position.
Figure 5B:
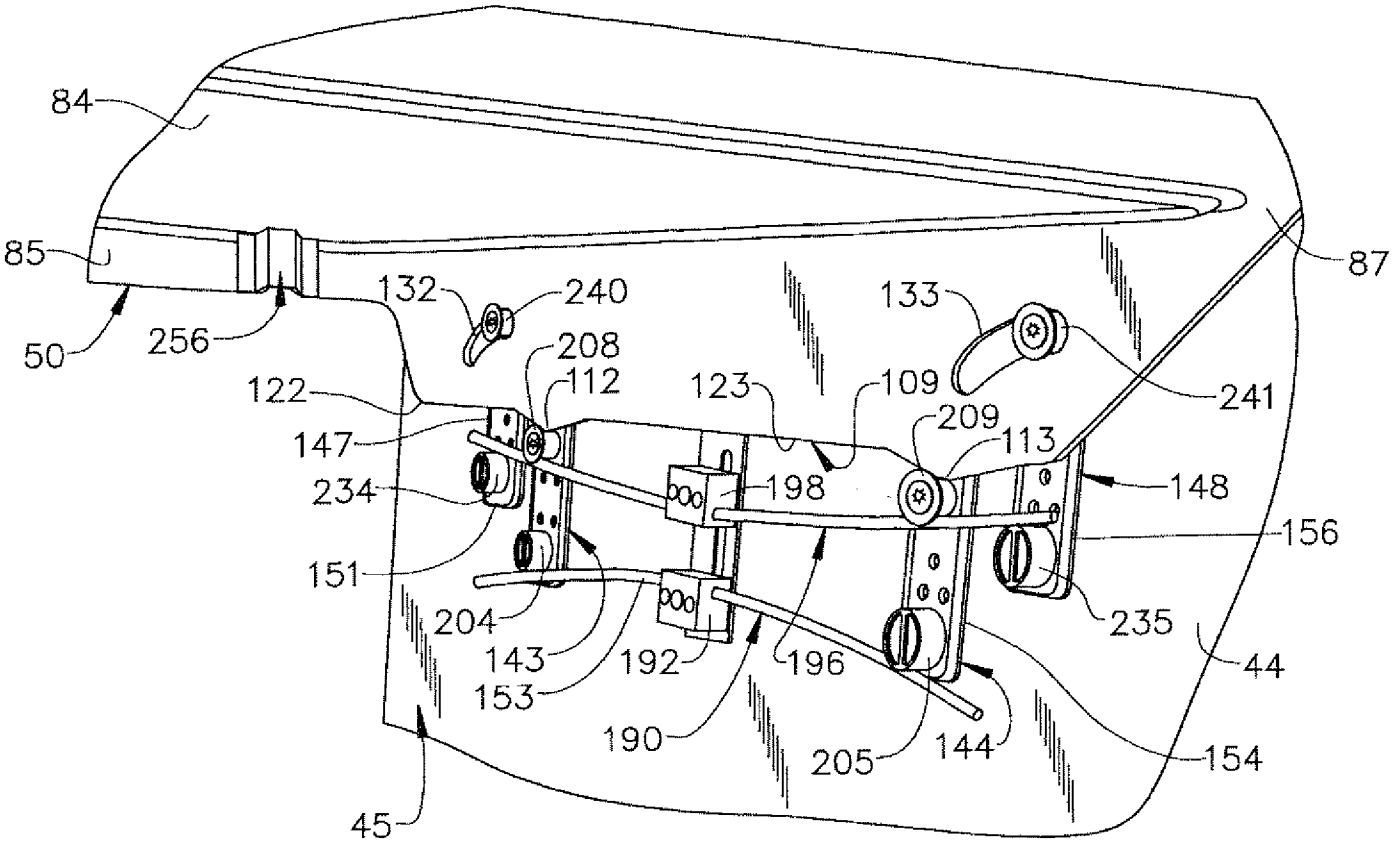
FIG. 5B is a detailed view of the lid operating mechanism of the present invention shown with the dishwasher lid in a lowered position.
Figure 6:
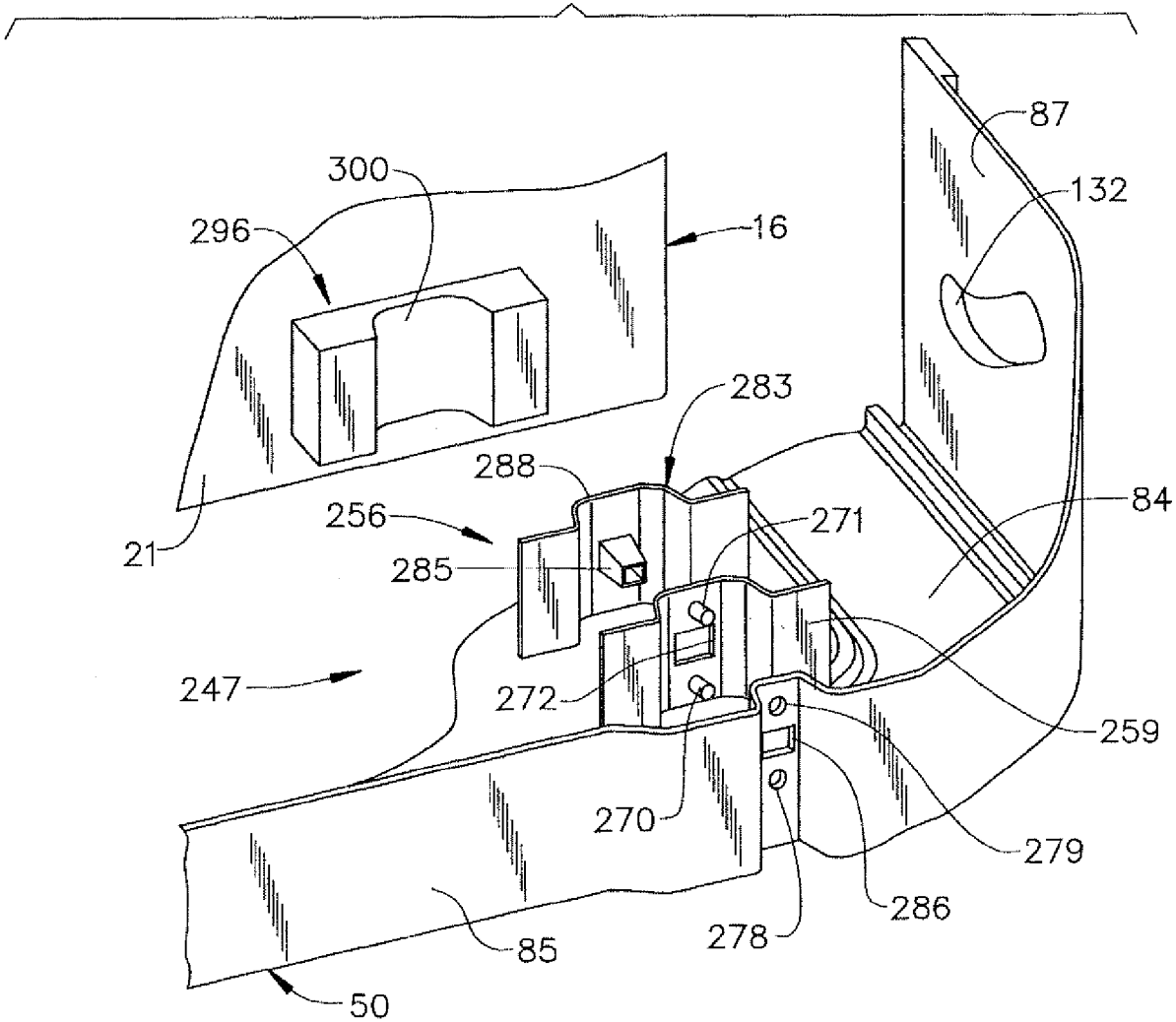
FIG. 6 is an exploded view of a lid alignment aide that ensures proper positioning of the dishwasher lid relative to a drawer of the dishwasher.

At this point, the description of operating mechanism 75 will proceed with describing structure incorporated into side wall 44 of outer housing 40 and it should be understood that corresponding structure is provided in side wall 43. Referring to FIGS. 5A and 5B, operating mechanism 75 includes first and second lifting sliders 143 and 144 and first and second compression sliders 147 and 148. As shown, lifting sliders 143 and 144 are slidably supported by side wall 44 at openings 153 and 154. Likewise, compression sliders 147 and 148 are slidably supported by side wall 44 at openings 155 and 156. With this arrangement, lifting sliders 143 and 144 and compression sliders 147 and 148 connect lid 50 to outer housing 40 while allowing lid 50 to be shifted between raised and lowered positions as will be detailed more fully below.

In further accordance with the invention, operating mechanism 75 includes a lifting spring 190 that extends between and abuts lifting sliders 143 and 144. Lifting spring 190 is secured to side wall 44 by a tensioning block 192. Tensioning block 192 can be vertically re-positioned along a support 193 so as to set a desired tension in lifting spring 190. In addition to lifting spring 190, operating mechanism 175 includes a compression spring 196 that extends between and acts upon compression sliders 147 and 148. In a manner similar to that described above, compression spring 196 is secured to side wall 44 by a tensioning block 198 that can be selectively, vertically re-positioned along support 193 to establish a desired tension in compression spring 196.

In still further accordance with the invention, each lifting slider 143, 144 includes a corresponding lifting spring support 204, 205. As shown, lifting spring 190 abuts lifting spring supports 204, 205 to urge lifting sliders 143, 144 upward to raise lid 50. Each lifting slider 143, 144 also includes a corresponding lifting roller 208, 209 which supports lower edge portion 109 of lid 50. Certainly, without a corresponding opposing force, lifting sliders 143 and 144 would maintain lid 50 in a constant raised position. In contrast, compression sliders 147, 148 include compression spring supports 234 and 235 which are acted upon by compression spring 196 to counteract the force applied by lifting spring 190. In a manner similar to that described above, compression sliders 147 and 148 are provided with corresponding compression rollers 240 and 241 which are positioned in arcuate openings 132 and 133 respectively. As will be discussed more fully below, compression rollers 240 and 241 travel within arcuate openings 132 and 133 as lid 50 transitions between the raised and lowered positions.

Of course, it is important to establish proper positioning of lid 50 in order to ensure a proper seal. Towards that end, operating mechanism 75 includes an alignment aide 249 best shown in FIG. 6. Alignment aide 249 includes an aligning element 256 having a first portion 259 that mounts to rear section 85 of lid 50. First portion 259 includes a pair of locating pins 270 and 271, as well as a central opening 272. Locating pins 270 and 271 extend through receiving apertures 278 and 279 formed in rear section 85 of lid 50. A second portion 283 of alignment element 256 is secured to first portion 259. Second portion 283 is preferably formed from a resilient material and includes a central tab 285 that extends through central opening 272 and on through a corresponding opening 286 formed in rear section 85 of lid 50. Once assembled, aligning element 256 establishes a protrusion, or localized raised portion, on rear section 85. Aligning element 256 is designed to nest within an aligning member 296 provided on rear wall 21 of drawer 16. Aligning member 296 includes a socket 300 having a shape designed to receive protrusion 288. With this arrangement, as drawer 16 is inserted into outer housing 40, aligning member 296 mates with aligning element 256 to ensure that lid 50 is properly positioned above washing tub 28.

Having described a preferred construction of operating mechanism 75, reference will now be made to FIGS. 2-5B in describing a preferred method of operation. In accordance with the most preferred form of the invention, lid 50 is typically biased to the raised position as represented in FIG. 5A. That is, until drawer 16 is inserted into outer housing 40, lifting spring 190 acts upon lifting spring supports 204 and 205 to ensure that lifting sliders 143 and 144 are in the raised position. In a manner that will be described more fully below, as drawer 16 is inserted into outer housing 40 and engages lid 50 through alignment aide 249, the combined force exerted by drawer 16 and compression spring 196 forces lid 50 onto washing tub 28 to establish an effective seal.

In accordance with the most preferred form of the invention, as drawer 16 is guided into outer housing 40, rear wall 21 contacts rear section 85 of lid 50. More specifically, as drawer 16 contacts lid 50, aligning member 296 and aligning element 256 interengage to ensure proper alignment. At this point, lid 50 becomes constrained against rear wall 21 of drawer 16 such that, as drawer 16 moves further aft in outer housing 40, so does lid 50. In any event, as drawer 16 continues to move into outer housing 40 towards a fully retracted position, the horizontal displacement of drawer 16 forces lower edges 108 and 109 of lid 50 to travel along lifting rollers 208 and 209. Likewise, compression rollers 240 and 241 travel within arcuate slots or openings 132 and 143. As lid 50 nears the fully closed or retracted position, raised portions 112 and 113 force lifting sliders downward against the tension provided by lifting spring 190, thereby causing a vertical translation in lid 50.

Once lid 50 has sufficiently translated vertically and a seal is established between top section 84 and washing tub 28, lifting sliders 143 and 144 force lifting spring 190 downward to a point at which a pre-load in spring 190 is overcome, allowing compression spring 196 to shift compression sliders 147 and 148 downward to a final position. The travel in lifting sliders 143 and 144, as well as compression sliders 147 and 148, acts as tolerance accumulators for the overall operating mechanism 75. It should also be noted that, as lid 50 travels along lifting rollers 208 and 209, a detent portion (not separately labeled) provided on lower sections 108 and 109 is reached. Once the detent point is reached, horizontal forces on the system are reversed. In other words, once the detent is passed, drawer 16 no longer requires a force to push it closed, rather drawer 16 will automatically shift to the fully closed position and seat upon drawer 16.

At this point it should be understood that the present invention provides a simple and cost effective operating mechanism that efficiently transitions a lid of a drawer-type dishwasher between open and closed positions. More specifically, the present invention establishes an easy to install, low maintenance activating system designed to have a prolonged service life for the dishwasher. Although described with reference to a preferred embodiment of the invention, it should be readily understood that various changes and/or modifications can be made to the invention without departing from the spirit thereof. In general, the invention is only intended to be limited by the scope of the following claims.

What is claimed is:

1. A method of operating a drawer-type dishwasher comprising:

shifting a drawer out from an outer housing of the dishwasher to expose a washing chamber;

simultaneously with shifting the drawer, urging at least one lifting slider upward to act upon a lid for the washing chamber;

raising the lid above the drawer to expose the washing chamber;

loading dishware into the washing chamber;

shifting the drawer into the outer housing, causing a rear wall of the drawer to abut the lid, urging at least one compression slider to shift downward, and causing the lid to be urged against an upper portion of the washing chamber to establish a seal between the drawer and the lid; and activating the dishwasher to perform a washing operation in the washing chamber.

2. The method of claim 1, wherein raising the lid is constituted by applying a biasing force to the at least one lifting slider, said biasing force being supplied by a lifting spring.

3. The method of claim 1, wherein lowering the lid includes applying a biasing force to the at least one compression slider to shift the lid downward while causing the lid to be urged against an upper portion of the washing chamber to establish a seal between the drawer and the lid.

4. The method of claim 1, further comprising: aligning the lid with the drawer by engaging an alignment element and an aligning member upon abutting the rear wall of the drawer with the lid.

5. The method of claim 1 wherein, as the drawer is shifted into and out of the outer housing, the lid is moved along both a horizontal plane and a vertical plane.

6. The method of claim 1 wherein, as the drawer is shifted out from the outer housing, the lid shifts upon rollers formed as part of the at least one lifting slider.

7. The method of claim 1 wherein, as the drawer is shifted into the outer housing, the lid shifts upon rollers formed as part of the at least one compression slider, said rollers moving along an arcuate slot formed in a side wall of the lid.

8. A method of operating a drawer-type dishwasher including a drawer shiftably mounted for movement into and out of an outer housing comprising:

when shifting the drawer out of the outer housing of the dishwasher, providing a biasing force to a lifting slider through a lifting spring coupled to the lifting slider to shift a lid for the drawer to a raised position in order to expose a washing chamber; and when shifting the drawer into the outer housing of the dishwasher, providing a biasing force to a compression slider through a compression spring to shift the lid to a lowered position against the drawer to establish a seal between the drawer and the lid.

9. The method of claim 8 wherein, upon shifting the drawer into the outer housing, causing a rear wall of the drawer to abut the lid, urging the compression slider to shift downward, and causing the lid to be urged against an upper portion of the washing chamber to establish the seal between the drawer and the lid.

10. The method of claim 9, further comprising: aligning the lid with the drawer by engaging an alignment element and an aligning member upon abutting the rear wall of the drawer with the lid.

11. The method of claim 8 wherein, as the drawer is shifted into and out of the outer housing, the lid is moved along both a horizontal plane and a vertical plane.

12. The method of claim 8 wherein, as the drawer is shifted out of the outer housing, the lid shifts upon rollers formed as part of the lifting slider.

13. The method of claim 8 wherein, as the drawer is shifted into the outer housing, the lid shifts upon rollers formed as part of the compression slider, said rollers moving along an arcuate slot formed in a side wall of the lid.

14. A method of operating a drawer-type dishwasher including a drawer shiftably mounted for movement into and out of an outer housing comprising:

shifting the drawer out from the outer housing of the dishwasher to expose a washing chamber, when shifting the drawer out of the outer housing of the dishwasher, simultaneously with shifting the drawer, urging at least one lifting slider upward to act upon a lid for the washing chamber thereby providing a biasing force to the lifting slider through a lifting spring coupled to the lifting slider to shift the lid for the drawer to a raised position thereby raising the lid above the drawer in order to expose the washing chamber;

loading dishwasher into the washing chamber;

shifting the drawer into the outer housing, when shifting the drawer into the outer housing of the dishwasher, causing a rear wall of the drawer to abut the lid, urging at least one compression slider to shift downward, and causing the lid to be urged against an upper portion of the washing chamber by providing a biasing force to a compression slider through a compression spring to shift the lid to a lowered position against the drawer to establish a seal between the drawer and the lid; and activating the dishwasher to perform a washing operation in the washing chamber.

* * * * *